United States Patent [19]

Csongor

[11] Patent Number: 4,706,402

[45] Date of Patent: Nov. 17, 1987

[54] CARTRIDGE LOADING DEVICE

[76] Inventor: Frank Csongor, 15 Morgan St., Wenham, Mass. 01984

[21] Appl. No.: 827,019

[22] Filed: Feb. 7, 1986

Related U.S. Application Data

[63] Continuation-in-part of Ser. No. 568,379, Jan. 5, 1984, Pat. No. 4,574,511.

[51] Int. Cl.[4] ..... F42B 39/06

[52] U.S. Cl. ..... 42/87

[58] Field of Search ..... 42/87, 88

[56] References Cited

U.S. PATENT DOCUMENTS

| | | | |
|---|---|---|---|
| 1,355,684 | 10/1920 | Northover | 42/87 |
| 1,786,537 | 12/1930 | Holek | 42/87 |
| 3,032,907 | 5/1962 | Parker | 42/88 |
| 4,574,511 | 3/1986 | Csongor | 42/87 |

FOREIGN PATENT DOCUMENTS

| | | | |
|---|---|---|---|
| 379179 | 8/1932 | United Kingdom | 42/88 |
| 770128 | 3/1957 | United Kingdom | 42/88 |

OTHER PUBLICATIONS

Materiel Soldl Mtrl (1960), pp. 52 and 53.

*Primary Examiner*—Charles T. Jordan
*Attorney, Agent, or Firm*—Wolf, Greenfield & Sacks

[57] ABSTRACT

An apparatus for the rapid loading of ammunition into a magazine including a housing having an open end to be received by the magazine. The housing has a receiving port into which the ammunition is disposed. There is preferably provided in combination with the apparatus a support pad for a plurality of rounds of ammunition with the support pad and ammunition being loaded into the receiving port of the housing. The housing has a means for limiting the position of the ammunition, typically a wall of the housing adapted to align the ammunition with the magazine. Means are provided supported at the housing remote from the open end thereof for contacting and driving the ammunition through the open end of the housing into the magazine.

21 Claims, 28 Drawing Figures

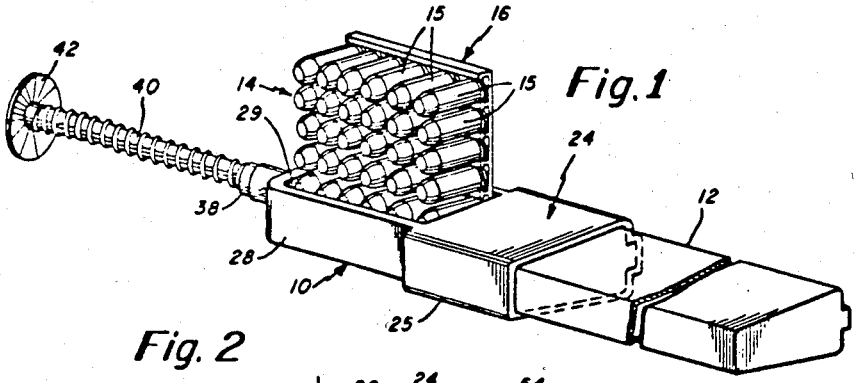
Fig. 1
Fig. 2
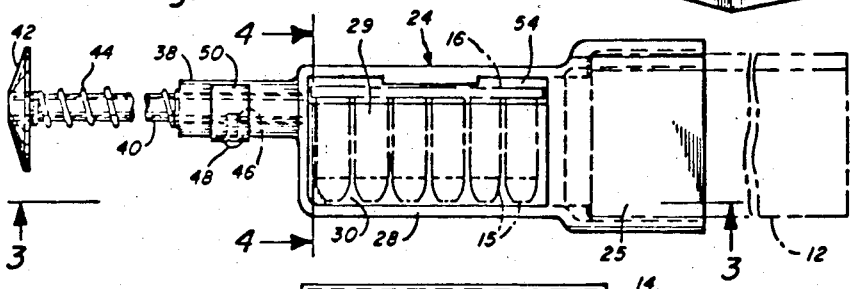
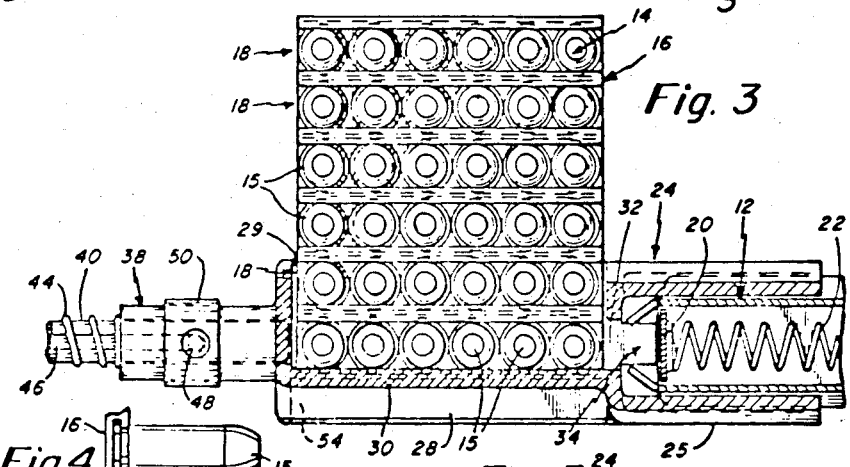
Fig. 3
Fig. 4
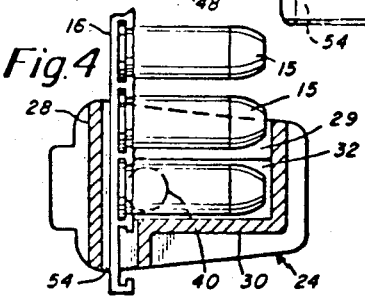
Fig. 5
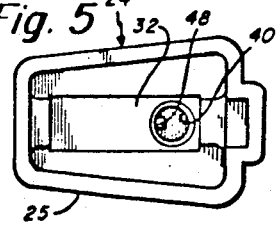

21
21

CARTRIDGE LOADING DEVICE

RELATED APPLICATION

This application is a continuation-in-part of application Ser. No. 568,379 filed Jan. 5, 1984 now U.S. Pat. No. 4,574,511.

BACKGROUND OF THE INVENTION

The present invention relates in general to a device or apparatus for loading ammunition into a magazine. More particularly, the invention is concerned with a device or apparatus which provides for the rapid loading of ammunition into a magazine used for holding a number of rounds of ammunition. In accordance with the rapid loading device of the present invention it is possible to load a complete magazine having, for example, 30 or 36 rounds of ammunition, in under three seconds.

A magazine is used for the purpose of storage of a number of rounds of ammunition. A magazine is typically used in conjunction with a firearm for the storage of the ammunition and the feeding thereof to the firing chamber of the firearm. By way of example, a magazine is used with a 9 mm, a 30 caliber carbine, a military 5.56 millimeter or 7.62×39 millimeter.

The loading of ammunition into a magazine is typically done by hand. This is a very time consuming process in which basically one round of ammunition at a time is loaded into the spring loaded magazine. Particularly in combat situations, there is a definite disadvantage in having to hand-load a magazine. Considerable time must be taken in loading the magazine before the magazine can be inserted into the weapon for use.

Accordingly, it is an object of the present invention to provide a device or apparatus for the rapid loading of a number of rounds of ammunition into a magazine.

Another object of the present invention is to provide a rapid loading device as in accordance with the preceding object and in which the magazine can be loaded quite rapidly in under three seconds; loading up to 36 rounds of ammunition.

A further object of the present invention is to provide an improved support pad for a number of rounds of ammunition, such as 30 or 36 rounds, which support pad with associated ammunition is adapted to be received by said loading device.

Another object of the present invention is to provide a support pad for an array of ammunition as in accordance with the preceding object and which is adapted to support a plurality of rounds of ammunition such as in a six by six or five by six array of ammunition rounds.

Still another object of the present invention is to provide an improved method of loading of a number of rounds of ammunition into a magazine, and in particular in which the method of loading is carried out rapidly.

A further object of the present invention is to provide a device or apparatus for the rapid loading of a number of rounds of ammunition into a magazine in which the ammunition is mounted on a support clip or pad and in which the clip substantially automatically feeds the rows of ammunition to the loader.

A further object of the present invention is to provide an improved apparatus for rapid loading of rounds of ammunition preferably supported on a support pad or support clip and in which the rounds advance under gravity feed, in which the clip exits vertically from the loader.

Another object of the present invention is to provide a rapid loading device as in accordance with the preceding object and in which there is provided self-guidance between the ammunition clip and the loader.

Still another object of the present invention is to provide an improved rapid loading device for ammunition in which the loading plunger has a radius end for accommodating the ammunition rounds and wherein furthermore the loading plunger is supported for axial but non-rotatable movement.

A further object of the present invention is to provide a rapid loading device for ammunition in which the moving parts of the device are fabricated so as to prevent wearing of the parts of the product.

A further object of the present invention is to provide a rapid loading device for ammunition including means for temporarily locking the device to the magazine to which the ammunition is being fed.

SUMMARY OF THE INVENTION

To accomplish the foregoing and other objects of this invention there is provided an apparatus for the rapid loading of ammunition into a magazine. This apparatus comprises a housing having an open end to be received by the magazine. This open end of the housing is positioned relative to the magazine to enable passage of ammunition from the housing into the magazine. The housing has a receiving port into which the ammunition is disposed. The housing is also provided with means for limiting the position of the ammunition so as to align the ammunition with the magazine. In this regard there is preferably provided a guide slot in the support clip for the ammunition that cooperates with a guide tab in the housing. Means are provided supported at the housing remote from the open end thereof for contacting and driving the ammunition through the open end of the housing into the magazine. In this regard the means for driving the ammunition may comprise a drive plunger that preferably has an end arcuate recess for accommodating the rounds and in which means are provided for permitting sliding action of the plunger along with non-rotation thereof so that the plunger is properly aligned with the rounds. In combination with the apparatus is support means preferably in the form of a support pad having multiple channels for supporting a plurality of rounds of ammunition. The support means and ammunition are loaded into the receiving port of the housing. The support means as indicated previously, preferably has a series of channels for supporting an array of ammunition rounds in multiple rows. The means for contacting and driving the ammunition is preferably a spring biased plunger which is adapted to contact a row of ammunition at a time. The subsequent rows of ammunition are fed by gravity so that after a row of ammunition is fed, the plunger retracts and the next row is fed into place by gravity and in readiness for feeding of the next row into the magazine.

In accordance with the method of the present invention there is provided a housing having an open end to be received by the magazine. The housing is positioned relative to the magazine to enable the passage of the ammunition from the housing into the magazine. The ammunition is loaded through a receiving port and it is loaded in a manner to limit the position of the ammunition so as to align the ammunition with the magazine. The ammunition is then contacted and driven through the open end of the housing into the magazine. In accordance with the method of the invention the ammunition is preferably provided in an array supported by a support pad having multiple channels for holding the ammunition in respective rows. The rows are contacted one at a time to load each row in sequence into the magazine.

BRIEF DESCRIPTION OF THE DRAWINGS

Numerous other objects, features and advantages of the invention should now become apparent upon a reading of the following detailed description taken in conjunction with the accompanying drawing, in which:

FIG. 1 is a perspective view showing one embodiment of the rapid loading device of the present invention in association with a magazine;

FIG. 2 is a top plan view of the apparatus of FIG. 1;

FIG. 3 is a cross sectional view through the apparatus housing as taken along line 3—3 of FIG. 2;

FIG. 4 is another cross sectional view taken along line 4—4 of FIG. 2;

FIG. 5 is an end view looking in the open end of the housing of the apparatus;

DETAILED DESCRIPTION

Figure 27:
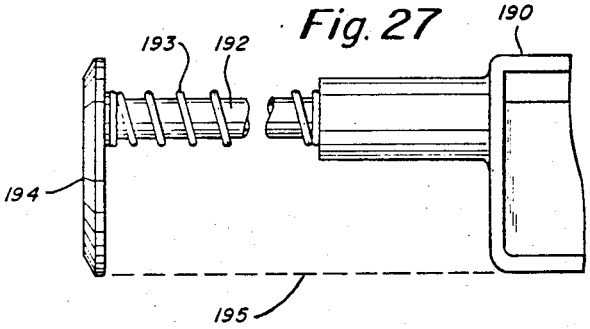
FIG. 27 is a schematic diagram illustrating an alternate actuating handle arrangement for the loader.
Figure 28:
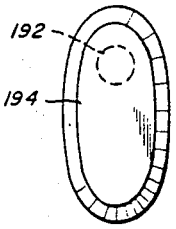
FIG. 28 is a side view showing the shape of the handle of FIG. 27.

FIGS. 1–9 illustrate a first embodiment of the present invention. FIG. 10 shows an alternate embodiment in which the biasing spring is disposed internally rather than in the external position illustrated in FIG. 1. A preferred embodiment of the present invention is illustrated in FIGS. 11–21. Still further alternate embodiments of the support clip are illustrated in FIGS. 22–26. FIGS. 27 and 28 illustrate an alternate actuating handle arrangement for the loader.

Reference is now made to the drawings and in particular to FIG. 1 which shows a perspective view of the rapid loading device of the present invention. The device 10 of the invention is shown in association with a conventional ammunition storage magazine 12. The concepts of the present invention may be employed in connection with any size or style of magazine. By way of example, magazines that may be employed include those used in association with a 9 millimeter, a 7.62×39 millimeter, a 30 caliber carbine, a military M16 carbine and other 9 millimeter or 45 caliber weapons. Some of these magazines have different shapes. The one illustrated in FIG. 1 has the general wedge shape and thus the device 10 is provided with a wedge-shaped opening. Other magazines may be more rectangular or may have other shapes and the device 10 is similarly shaped as to the opening that extends over the magazine.

FIG. 1 also shows an array 14 of ammunition including a plurality of individual ammunition rounds 15. All of the ammunition rounds are supported in a support pad 16. The details of the support pad 16 are illustrated in FIGS. 6–9 and are discussed in more detail hereinafter. It is also noted in FIG. 3 that the ammunition rounds 15 are disposed in respective rows 18. In the embodiment that is described there are six rows with each row having six rounds and thus there are a total of 36 ammunition rounds 15 supported by the support pad 16. FIG. 3 shows that the lowermost row 18 in position in the device 10 in readiness for being inserted into the magazine 12.

As mentioned previously, the magazine 12 is of conventional design and typically includes a sliding plate 20 schematically illustrated in FIG. 3 and some type of a spring 22 also schematically illustrated in FIG. 3. The rounds are urged against the plate and the magazine is constructed so that once the rounds are forced into the magazine they are retained in place in the magazine. Because the magazines that are used are of conventional design they are not shown in detail herein.

The rapid loading device 10 comprises a housing 24 having an enlarged open end 25 that is shaped to conform to the shape of the magazine 12. As indicated previously, in FIG. 1 the magazine 12 is of somewhat wedge-shape and thus the opening in the end 25 is also of similar shape with the inner dimensions of the opening corresponding in substance to the outer dimensions of the magazine. The fit of the magazine into the open end may be somewhat tight but is preferably not a force fit.

The housing 24 also includes an intermediate section 28 having at the top thereof an open receiving port 29 into which the ammunition array 14 is disposed. FIG. 3 shows the ammunition array 14 in position extending into the receiving port and having its downward position limited by means of the wall 30. FIG. 4 also shows the wall 30 of the intermediate section 28 and shows the lowermost row of ammunition rounds resting upon the wall 30. It is also noted in FIG. 4 that one of the rows thereunder has been stripped from the support pad 15 and has already been forced into the magazine. When this occurs the weight of the support pad and the remaining rounds simply feeds the next round thereabove into position such as in the position illustrated in FIG. 4 resting upon wall 30.

Reference is also made to FIG. 3 which shows the lowermost row 18 in line with the passage 32 that essentially bridges between the intermediate section 28 and the enlarged open end 25. It can be readily seen that the row of ammunition in place is directly in line with the passage 32 and in line with the opening 34 into the magazine 12.

The rapid loading device 10 also includes a support neck 38 integral with the intermediate section 28 extending therefrom. The neck 38 is hollow so as to receive the plunger shaft 40. The plunger shaft contacts the row of ammunition rounds and has at its outer end an actuating button 42. A biasing spring 44 extends about the shaft 40 between the button 42 and the neck 38. The shaft 40 is provided with an elongated groove 46 shown in FIG. 3. The groove 46 cooperated with the pin 48. The pin 48 is supported by a retaining collar 50 and the end of the pin 48 extends into the groove 46. At the inner end of the shaft 40 the groove 46 terminates as illustrated in FIG. 3 and thus the combination of the groove and the pin limits the outer travel of the plunger. The pin and groove also prevent rotation of the plunger shaft 40 in the neck 38. In FIGS. 1 and 3 the plunger is shown completely withdrawn. In order to force a row of rounds into the magazine the plunger is actuated by rapid hand action to strip a row of the ammunition from the support pad directing the row into the magazine.

When the plunger is struck by the hand as indicated the row of ammunition is forced into the magazine and is retained therein by virtue of the construction of the magazine. The spring 40 provides for an immediate return of the plunger. With the ammunition having now been stripped from the first row, the array of ammunition with the associated support pad 16 falls by gravity until the next row contact the wall 30 such as illustrated in FIG. 4. It is noted in FIG. 4 that the bottom row of ammunition has been stripped from the support pad 16, showing the support pad in that first row without any ammunition therein. FIG. 4 also shows a slot 54 adjacent to the wall 30 which enables passage of the support pad 16 out through the bottom of the housing. When the last row of ammunition has been contacted and forced into the magazine then the support pad 16 simply falls from and is free of the housing. The support pad 16 simply falls through the slot 54. The support pad 14 may then be refilled for subsequent use.

Figure 6:
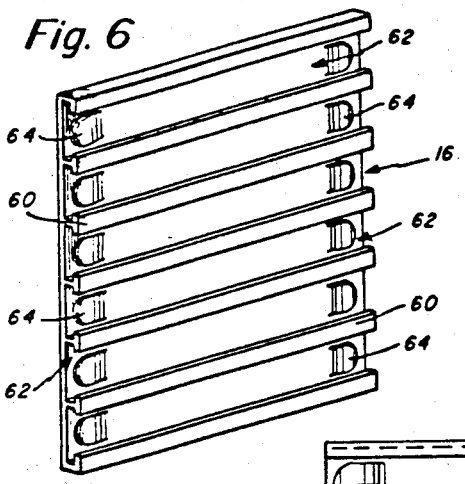
FIG. 6 is a perspective view of the support pad for the multiple rounds of ammunition.
Figure 7:
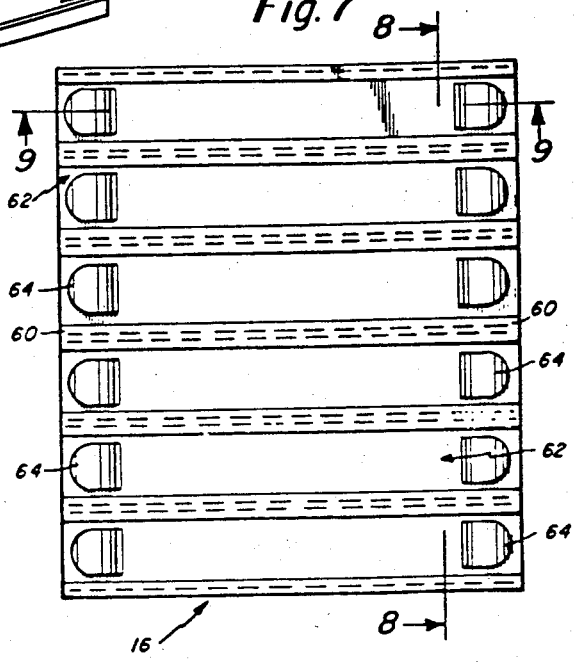
FIG. 7 is a plan view of the pad of FIG. 6.
Figure 8:
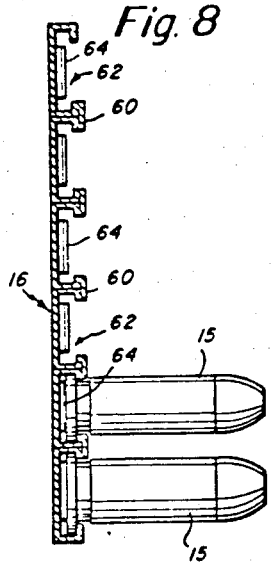
FIG. 8 is a cross sectional view taken along line 8—8 of FIG. 7 showing the individual support channels of the support pad.
Figure 9:
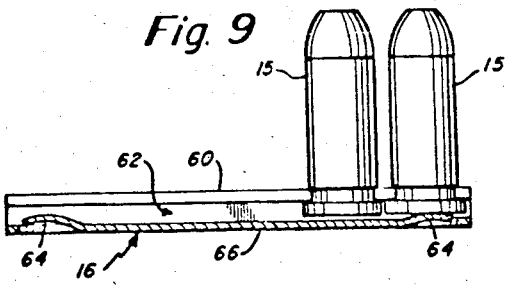
FIG. 9 is a cross sectional view taken along line 9—9 of FIG. 7 showing two rounds in place in one of the support channels.
Figure 10:
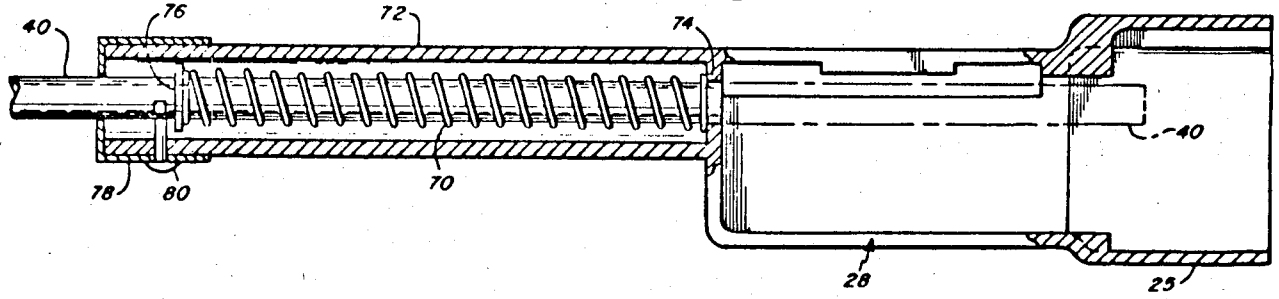
FIG. 10 is a plan view of an alternate embodiment in accordance with the invention in which the biasing spring is internally supported rather than externally supported as in FIG. 1.

FIGS. 6–9 show further details of the support pad 16. As indicated previously, this support pad is for supporting a plurality of rows 18 of ammunition. Thus, the pad is provided with T-shaped walls 60 that separate the pad into multiple round-receiving channels 62. By virtue of the walls 60 being T-shaped, and as illustrated in FIGS. 8 and 9, each of the rounds 15 fits within the channel 62 and is prevented from being lifted thereout by virtue of contact with the base of each ammunition piece with the underside extension of each of these T-shaped walls 60.

In order to prevent lateral movement of the rounds, there is provided at each end of each channel 62 a spring tab 64. Each of the spring tabs 64 is formed by punching out the base 66 such as illustrated in FIG. 9. FIG. 9 also illustrates one of the end rounds 15 being forced by the tab 64 so that the round is urged against the top flange of the T-shaped wall 60. The intermediate rounds between the two end rounds are retained in place by being limited between the two outside rounds. The spring action provided by the spring tabs 64 is sufficient to hold the ammunition in place in the support pad but is not too great a force so that when the plunger is used to extract the row of ammunition each row readily slides in its associated channel 62 from the support pad.

Reference is now made to FIG. 10 which shows an alternate embodiment of the invention. Previously, in FIGS. 1–5 the return spring 40 was used to provide for the rapid return of the plunger in readiness for the next manual forcing step to force the next row of ammunition into the magazine. In the alternate embodiment of FIG. 10 like reference characters are used where applicable and in this embodiment there is provided a spring 70 about the plunger shaft 40. The spring 70 is contained within the neck 72 rather than externally as in the first embodiment. In this alternate embodiment the neck 72, as noted, is longer. The spring 70 is seated at one end against the wall 74 of the housing and is supported at the other end by a support disc 76 which is fixed to the shaft 40. FIG. 10 also shows the end member 78 and associated pin 80. In this embodiment the shaft 40 also preferably has an elongated groove into which the pin 80 extends. Again, this limits the outer travel of the shaft 40 and also prevents rotation of the shaft 40.

In FIG. 10 the shaft 40 is shown in solid in its normal rest position. FIG. 10 also shows in phantom the shaft being extended so as to force a row of ammunition into the magazine. The spring 70 causes a return of the plunger when the plunger is released.

In accordance with the present invention it is possible to adapt the housing, as mentioned previously, to receive magazines of any size and shape. Ammunition of any size and type can also be accommodated. If a larger round is to be accommodated then the receiving port may be made correspondingly larger. Also, if the magazine is larger, then the housing is also made larger so as to accommodate it.

In accordance with another feature of the present invention, illustrated in FIG. 1 is a wedge shaped housing. As mentioned, the magazine could also be rectangular. The same mold can be used with an insert with the insert being used in order to provide the wedge shape. When the insert is not used then the mold provides for the usual rectangular shape so as to accommodate a rectangular magazine.

Also, in accordance with the invention the combination of plunger and return spring action enables loading extremely quickly. The entire array of ammunition can be loaded in less than three seconds quite easily. Each time that the plunger is moved manually the row of ammunition is entered into the magazine. The spring action returns the plunger and then the array falls until the next row is in place. This action repeats until the entire array of ammunition has been driven into the magazine. When this occurs then the support pad simply falls through the slot 54 and falls from the device housing.

Figure 11:
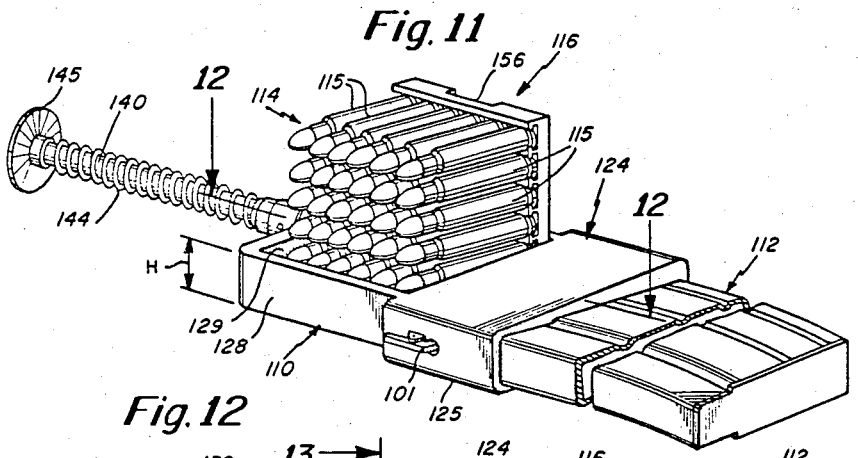
FIG. 11 is a perspective view showing a further embodiment of the rapid loading device of the present invention in association with a magazine.

Reference is now made to the embodiment of the invention illustrated in FIGS. 11–21. In this regard there is shown in FIG. 11 a perspective view of a preferred embodiment of the rapid loading device of the present invention. The device 110 is shown in association with a conventional ammunition storage magazine 112. The concepts of the present invention may be employed in connection with any size or style of magazine. By way of example, magazines that may be employed include those used in association with a 38 super automatic, a 30 caliber carbine, a military M16 carbine and other 9 millimeter or 45 caliber weapons. Some of these magazines have different shapes. It is noted that the magazine illustrated in FIG. 11 differs from the one previously described in association with FIG. 1. However, both of the magazines are generally of wedge shape.

FIG. 11 also shows an array 114 of ammunition including a plurality of individual ammunition rounds 115. All of the ammunition rounds are supported in a support pad or support clip 116. The details of the support clip 116 are illustrated in FIGS. 12, 13, and 18–21 and are discussed in more detail hereinafter. It is also noted in FIG. 15 that the ammunition rounds 115 are disposed in respective rows 118. In the embodiment that is described there are six rows with each row having six rounds as illustrated in FIG. 11 and thus there are a total of 36 ammunition rounds supported by the support clip 116. In this regard, FIG. 15 shows one of the rows 118 still remaining in the clip with a row thereunder having just been inserted into the magazine 112.

In accordance with the invention, the support clip is preferably constructed of a plastic material and may be considered as a throw-away item. It is thus desirable to make it of a relatively inexpensive material such as plastic. One form of support clip is illustrated in FIGS. 18–21 and other embodiments are illustrated in FIGS. 22–26 to be described in further detail hereinafter.

Figure 13:
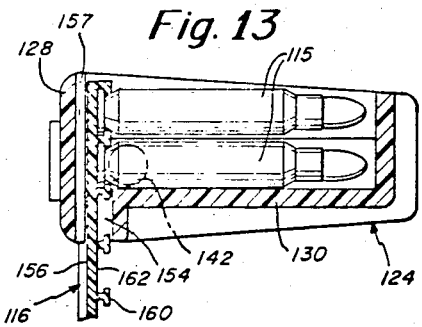
FIG. 13 is a cross-sectional view taken along line 13—13 of FIG. 12 and further illustrating the gravity feed concepts of the invention.
Figure 14:
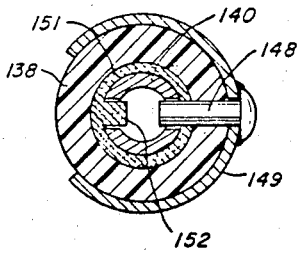
FIG. 14 is a cross-sectional view taken along line 14—14 of FIG. 12 further illustrating the plunger guidance.
Figures 15, 16, 17, 18, 19, 20, 21:
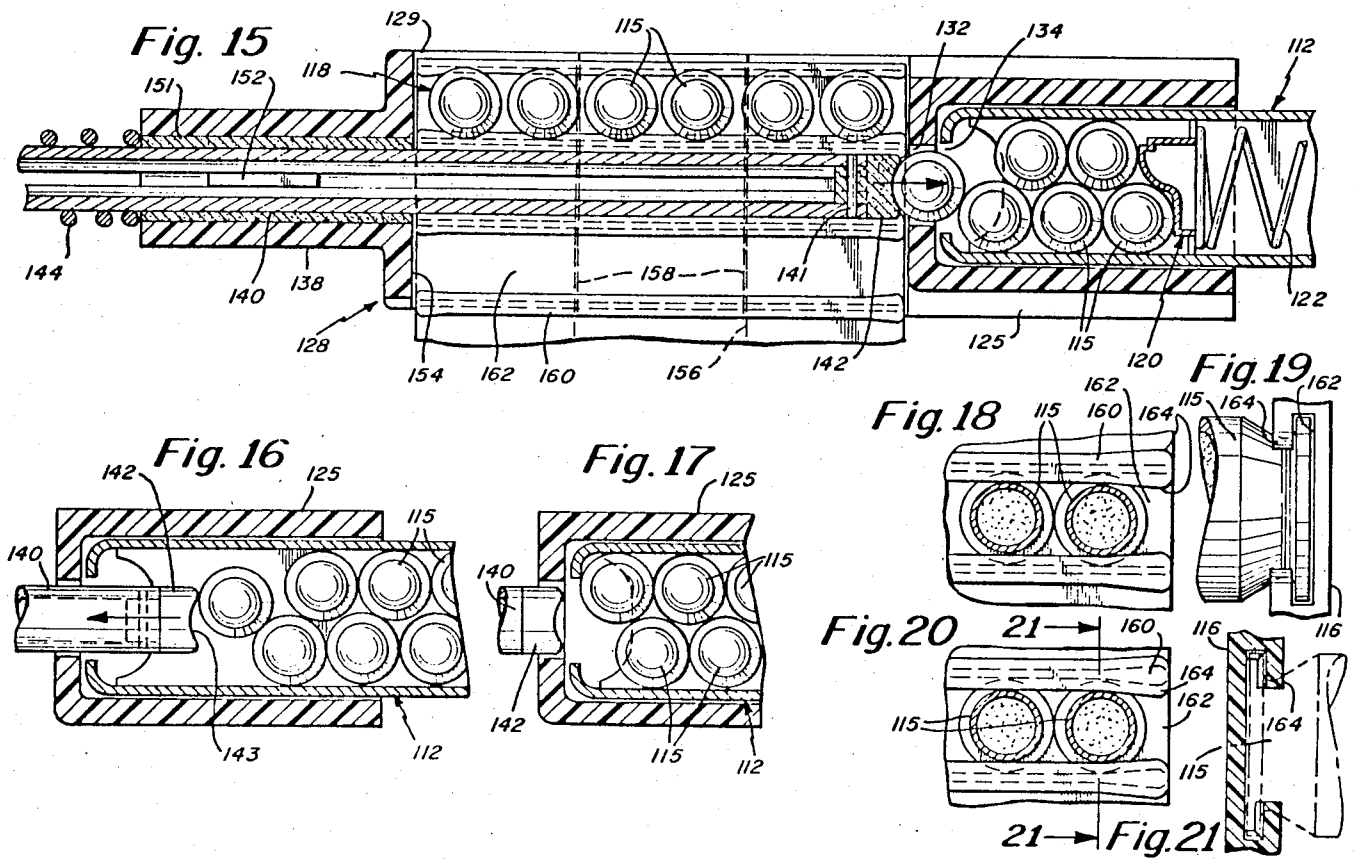
FIG. 15 is a cross-sectional view taken along line 15—15 of FIG. 12 further illustrating the loading of rounds into the magazine.
FIG. 16 is a fragmentary view similar to the cross-section of FIG. 15 illustrating plunger withdrawal.
FIG. 17 is a further fragmentary cross-sectional view illustrating the plunger in its position just withdrawn from the magazine with the magazine fully loaded.
FIG. 18 is a fragmentary view of a portion of the ammunition support clip in which the rows for the ammunition are defined by narrow slots to retain the rounds.
FIG. 19 is a fragmentary side elevation view of the clip construction of FIG. 18.
FIG. 20 is a fragmentary view similar to the one of FIG. 19 but illustrating a slightly different alternate embodiment employing a conical channel construction.
FIG. 21 is a cross-sectional view taken along line 21—21 of FIG. 20.

The magazine 112 and the embodiment of FIGS. 11–21 is of conventional design and typically includes a sliding member 120 as illustrated in FIG. 15 and some type of a spring 122. The rounds are urged against the member 120 and the magazine is constructed so that once the rounds are forced into the magazine they are retained in place in the magazine such as in the position illustrated in FIG. 17 in which the magazine is considered to be fully loaded. Because the magazines that are used are of conventional design, they are not shown in detail herein.

The rapid loading device 110 comprises a housing 124 having an enlarged open end 125 that is shaped to conform to the shape of the magazine 12. The magazine 112, as previously indicated, is of somewhat wedge-shape and thus the opening in the end 125 is also of similar shape with the inner dimensions of the opening corresponding in substance to the outer dimensions of the magazine. The fit of the magazine into the open end may be somewhat tight but is preferably not a force fit.

Figure 12:
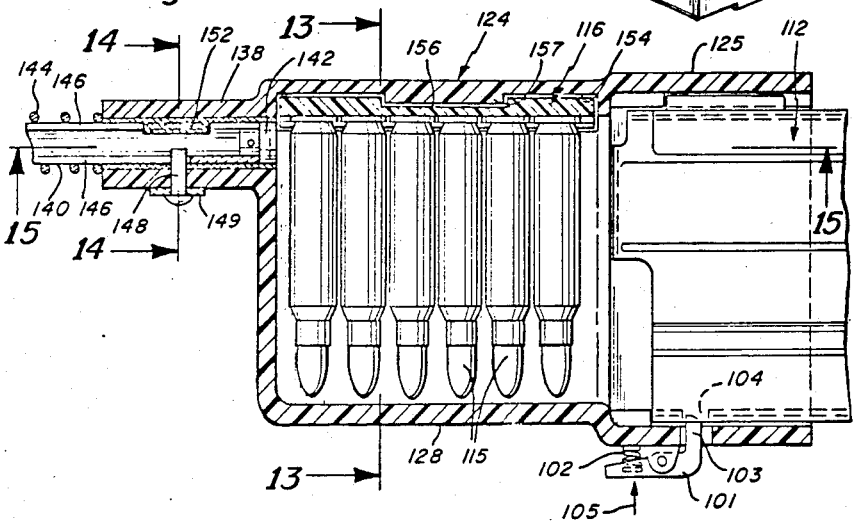
FIG. 12 is a cross-sectional view taken along line 12—12 of FIG. 11 showing further details of the clip-to-housing guidance and the plunger guidance.

Reference is now made to FIG. 12 which shows a locking arrangement associated with the end 125 of the housing. This is illustrated in FIG. 12 by the lock 101 suitably supported from the outer face of the end 125 and adapted to be biased via spring 102 to a locked position in which the latch end 103 thereof extends through a hole in the housing 124 into a slot 104 provided in the magazine 112. To release the magazine, the lock 101 is moved against the bias of spring 102 in the direction of arrow 105 so that the lock pivots and the latch end 103 disengages from the slot 104. However, in the locked position, the arrangement provides for an interlocking between the loader housing and the magazine so that the magazine is not expelled from the open end of the housing when the plunger force is applied to convey a row of ammunition into the magazine.

The housing 124 also includes an intermediate section 128 having at the top thereof an open receiving port 129 into which the ammunition array 114 is disposed. In this regard FIG. 15 shows the ammunition array 114 extending into the receiving port 129 and having its downward position limited by means of the wall 130 as illustrated in FIG. 13. FIG. 13 shows two of the uppermost rows in position with the lowermost one thereof resting upon the wall 130. It is also noted in FIG. 13 that other ones of the rows thereunder have been stripped from the support clip 116 and have already been forced into the magazine. When this stripping action occurs the weight of the support clip and the remaining rounds simply feeds the next round thereabove into position such as in the position illustrated in FIG. 13 resting upon wall 130.

Reference is also made to FIG. 15 which shows one of the rows 118 having just been transferred through the passage 132 interconnecting the intermediate section 128 and the open end 125. In this regard it can be readily seen that the plunger is in place in direct alignment with the passage 132 and also in alignment with the opening 134 into the magazine 112.

The rapid loading device 110 also includes a support neck 138 integral with the intermediate section 128 and extending therefrom. The neck 138, such as illustrated in FIGS. 12 and 15 is hollow so as to receive the plunger shaft 140. The plunger shaft contacts the row of ammunition rounds and has at its outer end an actuating button 142. The actuating button 142 is supported from the shaft 140 at one end thereof by means of the support pin 141 as illustrated in FIG. 15. It is noted that the plunger shaft 140 is hollow so as to readily receive the actuating button 142. It is furthermore noted, as illustrated in FIGS. 15–17, that the actuating button 142 has an arcuate end as indicated at 143 with the arcuate shape thereof conforming to the general cylindrical diameter of an ammunition round. In FIG. 15 in particular, the button 142 is shown urged against one of the rounds of ammunition and clearly illustrates the manner in which the arcuate end 143 positively engages the round.

A biasing spring 144 extends about the shaft 140 between the actuating disk 145 and the neck 138. The shaft 140 is provided oppositely disposed elongated slots 146 shown in FIG. 12. One of the grooves 146 cooperates with the pin 148 extending through the support neck 138. In this regard refer to FIG. 14 which clearly shows the pin 148 along with its associated circumferential washer 149. FIG. 14 also shows the support neck 138 and support bearing 151 having associated therewith a guide lug 152 that extends into the opposite slot 146.

As indicated previously, the pin 148 is supported by a retaining washer or collar 149 and the end of the pin 148 extends into the slot 146. At the inner end of the shaft 140, the slot 146 terminates as illustrated in FIG. 12 and thus the combination of the slot and the pin limits the outer travel of the plunger. The pin 148 in combination with the guide lug 152 and the slots 146 also prevent rotation of the plunger shaft 140 in the neck 138.

In FIGS. 11 and 12, the plunger is illustrated completely withdrawn from the housing. In FIG. 12 in particular, it is noted that the pin 148 is at the very end of the lower slot 146. In order to force a row of rounds into the magazine the plunger is actuated at the actuating disk 145 by rapid hand action to strip a row of the ammunition from the support clip directing the row into the magazine.

When the plunger is struck by the hand, as indicated, the row of ammunition is forced into the magazine and is retained therein by virtue of the construction of the magazine. The spring 140 provides for an immediate return of the plunger. With the ammunition having now been stripped from a row of the clip, the array of ammunition with the associated support clip 116 falls by gravity until the next row contacts the wall 130 such as illustrated in FIG. 13. In this connection in FIG. 15, all of the rows of ammunition have been stripped with the exception of the very top one thereof. Also, in FIG. 15, the plunger is shown at its furthermost position to the right or into the housing.

As illustrated in FIG. 13, the gravity feed concepts are enabled by virtue of the intermediate section 128 of the housing having a slot 154 through which the clip 116 may fall. The slot 154 is adjacent to the wall 130 and enables passage of the support clip 116 out through the bottom of the housing. When the last row of ammunition has been contacted and forced into the magazine then the support clip 116 simply falls from and is free of the housing. The support clip 116 simply falls through the slot 154. The support clip 116 may then be refilled for subsequent use.

In accordance with one feature of the preferred embodiment of the invention, and as noted in FIGS. 11–13, there is provided for a positive interlocking and guidance system between the loader housing and the support clip 116. In this regard, the support clip 116 is provided with a centrally disposed elongated slot 156 that is adapted to slidably engage with the similarly shaped ridge 157 associated with the intermediate section 124 of the housing. In this regard, refer to FIG. 15 which shows in dotted outline at 158. The dyed slot and ridge arrangement for providing positive guiding and interlocking between the support clip and the housing. This arrangement prevents the support clip from being skewed and assures that there will be proper alignment of a round of ammunition between the plunger and the open end 125.

FIGS. 11–13 along with FIGS. 18–21 show further details of the support clip 116. As indicated previously, this support clip is for supporting a plurality of rows 118 of ammunition. The clip is provided with T-shaped walls 160 that separate the clip into multiple round-receiving channels 162. By virtue of the walls 160 being T-shaped, as illustrated in FIG. 18, each of the rounds 115 fits within the channel 162 and is prevented from being lifted thereout by virtue of contact of the base of each ammunition round with the underside extension of each of these T-shaped walls 160.

In order to prevent lateral movement of the rounds, in the embodiment of the invention illustrated in FIGS. 6–9, there were provided spring tabs 64. However, in a preferred embodiment of the invention the support clip is constructed of plastic and the rounds are retained by virtue of shaping the walls 160. This is illustrated in FIG. 18 in one version and in FIG. 20 in a slightly different version. In FIG. 18, the upright part of the T-shaped walls as a constant thickness, but the side extensions thereof are modified so that the slots 162 essentially taper. In this regard, note the extensions 164 in FIG. 19 and also note in FIG. 18 in the plan view how these widen out to provide a corresponding narrowing of the slot.

FIGS. 20 and 21 show an alternate embodiment of the invention in which both the extensions 164 are varied in order to narrow the slot and likewise the upright part of each of the T-shaped walls is also changed in dimension as indicated by dotted outline in FIG. 20. There is thus provided a narrowing of the slot with regard to contact by the round both at the very base of the round and the diameter of the round where the extensions interact. In FIGS. 18–21, the altering of the wall construction to provide a narrowing of the slots is preferred and this is believed to be a simpler construction than use of separate spring tabs as illustrated in, for example, FIG. 9.

In connection with the support clip of the preferred embodiment, it is noted that the intermediate rounds in a row between the two end rounds are retained in place by being limited between the two outside rounds. The spring action provided by the widening of the walls 160 at their ends is sufficient to hold the ammunition in place in the support clip but is not too great a force. Thus, when the plunger is used to extract the row of ammunition, each row readily slides in its associated channel 162 from the support pad or support clip.

In accordance with one feature of the present invention, it is preferred to have contacting or moving surfaces constructed for ruggedness and wear. In this regard, it is preferred to have some of the components constructed with a hardened surface. This may be a stellite surface such as used with the actuating button 142, particularly on its radius surface 143. The stelliting provides a mirror finish and is carried out by means of a plasma arc transfer technique that is conventional in the art. The bearing 151 may be similarly constructed to provide good wearing qualities.

In accordance with one features of the invention, it is preferred to have the intermediate section 128 of the housing of a height H as indicated in FIG. 11 that is preferably in the range of 1.5–2.0 rounds. It is desired to have the depth of the intermediate section that receives the rounds of at least sufficient depth so that the proper stability occurs as the rounds are being transferred.

As indicated previously, in FIG. 15, one of the rows of rounds is being transferred to the magazine. In FIG. 16, the entire row has been expelled into the magazine and the plunger is then shown being moved in the opposite direction. With the plunger at the end of its stroke, the release of pressure on the bullet by the radiused face of the plunger allows the bullet to rotate to a locking position. FIG. 17 shows the plunger having been withdrawn entirely from the magazine and illustrates the rounds interlocked in a fixed position in the magazine.

Figure 22:
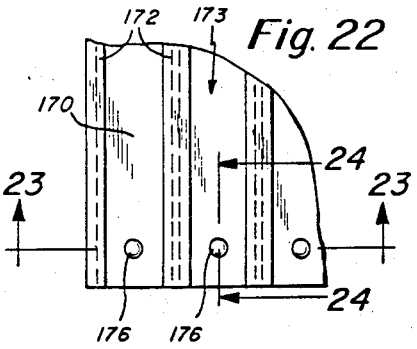
FIG. 22 is a fragmentary view of an alternate support clip showing alternate means for retaining rounds in the clip.
Figure 24:
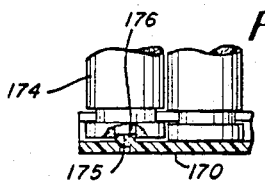
FIG. 24 is a cross-sectional view taken along line 24—24 of FIG. 22 showing further details.
Figure 23:
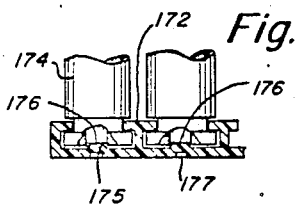
FIG. 23 is a cross-sectional view taken along 23—23 of FIG. 22 showing further details of the nipple-type retainer.

Reference is now made to FIGS. 22–24 which illustrate an alternate preferred embodiment for the uniclip. The uniclip is made of plastic in this version and includes a base 170 having extending upwardly therefrom a series of walls 172 such as the T-shaped wall 172 illustrated in FIG. 23. These T-shape walls define channels for receiving each of the individual rounds 174. In this regard, it is noted that each round has a primer hole 175 in the center thereof.

At the end of each of the channels 173 as illustrated in FIG. 22, there is provided a retaining nipple 176. This may be formed by punching the plastic out forming an indentation such as at 177 that protrudes up into the aforementioned nipple 176. The nipple is adapted to fit within the primer hole 175. In this regard, refer to FIG. 24 which shows the round 174 with the primer hole 175 and the nipple 176 extending thereinto. As noted, the retaining nipple is only provided at the end of the channel and engages only with the two end bullets at either end of the channel.

Figure 25:
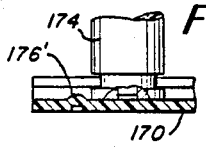
FIG. 25 is a cross-sectional view similar to FIG. 24 showing an alternate inter-relationship between the retaining nipple and round.

A slightly alternate embodiment of the invention is illustrated in FIG. 25 in which the retaining nipple 176' is not disposed within the primer hole, but is instead disposed and the uniclip is dimensioned so that the end round, such as the round 174 illustrated in FIG. 25 is captured by the retaining nipple 176'. Again, the retaining nipple may be provided by punching the end of the channel to form an indentation thereunder and a protruding nipple thereover as illustrated in FIG. 25.

Figure 26:
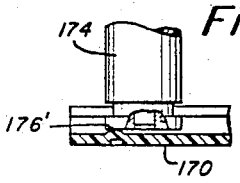
FIG. 26 is a cross-sectional view similar to that of FIG. 24 showing still another inter-relationship between the support pad and round.

FIG. 26 shows a final embodiment of the invention in which the retaining nipple 176' is provided so that there is a force-fit between the round 174 and the top of the retaining nipple. In this regard, it is noted that the bullet has an annular channel so that it is properly received in the channel of the uniclip and once the bullet comes into contact at its lower surface with the retaining nipple, then it is retained in position by a force-fit engagement.

Hereinbefore in FIGS. 11 and 12, there has been described an embodiment in which there is provided an actuating button for providing translation of the rows of rounds into the magazine. FIG. 27 shows an alternate embodiment including a loader housing 190, an actuating shaft 192, biasing spring 193, and actuating handle 194. As noted in FIG. 28, the handle 194 is substantially of oval shape providing a larger area and an area of impact with the hand that is adapted to conform more readily to the shape of the palm of the hand. This enhances the operability of the plunging action as rounds are extracted from the loader into the magazine. As noted in FIG. 27, the bottom end of the handle preferably is substantially in line with the bottom of the housing 190 as indicated by the dotted line 195.

Having now described a limited number of embodiments of the present invention, it should now be apparent to those skilled in the art that numerous other embodiments and modifications thereof are contemplated as falling within the scope of the present invention as defined by the appended claims.

What is claimed is:

1. Apparatus for rapid loading of a plurality of rounds of ammunition into a magazine, comprising:

a housing having an open end to be received by the magazine and positioned relative to the magazine to enable passage of the ammunition from the housing into the magazine, said housing having a receiving port into which the ammunition is disposed;

said housing having means for limiting the position of the ammunition so as to align the ammunition with the magazine, means supported at the housing remote from the open end thereof for contacting and driving the ammunition through the open end of the housing into the magazine, support means for the plurality of rounds of ammunition, said support means and ammunition being loaded into the receiving port of the housing, said support means and housing inter-engaging guide means for guidance of said support means as it is loaded into the receiving port of the housing, one of said support means and housing having a slot and the other of support means and housing having a ridge.

2. Apparatus as set forth in claim 1 wherein said slot is in the support means and said ridge is in the housing.

3. Apparatus as set forth in claim 2 wherein said support means comprises a support pad having a base and means defining a plurality of channels for separate rows of ammunition.

4. Apparatus as set forth in claim 3 including means at each end on each channel for retaining the end rounds of ammunition in the channel.

5. Apparatus as set forth in claim 4 wherein said end channel retainers comprise end spring tabs.

6. Apparatus as set forth in claim 5 wherein said means defining the channels comprise spaced T-shaped walls.

7. Apparatus as set forth in claim 1 wherein said means for limiting the position of the ammunition comprises a wall of the housing.

8. Apparatus as set forth in claim 7 including support means for a plurality of rounds of ammunition including a support pad and wherein said support pad is disposed orthogonally to said limiting wall.

9. Apparatus as set forth in claim 1 wherein said means for contacting and driving includes plunger means having a plunger shaft.

10. Apparatus as set forth in claim 9 including means for biasing the plunger means to a retracted position, said plunger means including a somewhat elongated handle adapted to conform to the operator's palm-shape.

11. Apparatus as set forth in claim 10 wherein said housing has a neck portion extending therefrom for accommodating said plunger means.

12. Apparatus as set forth in claim 11 wherein said means for biasing comprises a spring disposed about the plunger shaft.

13. Apparatus as set forth in claim 11 wherein said biasing means comprises a spring contained in said neck portion.

14. Apparatus as set forth in claim 1 including support means for a plurality of ammunition, the support means and ammunition being loaded into the receiving port of the housing, and a slot in the housing for receiving the support means.

15. Apparatus as set forth in claim 1 wherein, said means for contacting and driving including plunger means having an arcuate concave contacting end of a shape corresponding substantially to the shape of the round.

16. Apparatus as set forth in claim 15 wherein said arcuate surface is hardened.

17. Apparatus as set forth in claim 1 including, means for supporting and enabling sliding action of said contacting and driving means but inhibiting rotation thereof.

18. Apparatus as set forth in claim 1 including bushing means in the housing for supporting said means for contacting and driving, said latter means comprising a plunger means supported in the bushing means.

19. Apparatus as set forth in claim 18 including a hardened surface on the bushing means for wear purposes.

20. Apparatus for rapid loading of ammunition rounds into a magazine, comprising:

a housing having an open end to be received by the magazine and positioned relative to the magazine to enable passage of the ammunition from the housing into the magazine, said housing having a receiving port into which the ammunition is disposed, said housing having means for limiting the position of the ammunition so as to align the ammunition with the magazine, means supported at the housing remote from the open end thereof for contacting and driving the ammunition through the open end of the housing into the magazine, said means for contacting and driving including plunger means having an arcuate round contacting end of a shape corresponding substantially to the shape of the round, said plunger means having oppositely disposed slots for receiving means for enabling sliding of said plunger means but inhibiting rotation thereof.

21. Apparatus as set forth in claim 20 wherein said means for inhibiting rotation comprises a pin extending into one of the slots and a guide lug extending into the other of the slots, both of the slots extending longitudinally of the plunger means.

* * * * *